United States Patent [19]

Murphy et al.

[11] Patent Number: 4,463,836

[45] Date of Patent: Aug. 7, 1984

[54] SNAP-ON SLIDE BEARING FOR U-SECTION TYPE UNIT BRAKE BEAM GUIDE LUGS

[75] Inventors: Richard F. Murphy, Batavia; Michael K. Murphy, Aurora, both of Ill.

[73] Assignee: Holland Co., Aurora, Ill.

[21] Appl. No.: 429,276

[22] Filed: Sep. 30, 1982

[51] Int. Cl.[3] ..... B61H 13/00

[52] U.S. Cl. ..... 188/52; 188/209; 188/212; 188/233.3

[58] Field of Search ..... 188/52, 53, 54, 55, 188/49–51, 195, 197, 206 R, 207, 209, 212–215, 219.1, 233.3, 233.7, 226.1; 308/3 R; 213/21, 61; 105/168, 182 R, 206 R

[56] References Cited

U.S. PATENT DOCUMENTS

| | | | |
|---|---|---|---|
| 2,918,149 | 12/1959 | McClure et al. | 188/197 |
| 3,207,271 | 9/1965 | Polanin et al. | 188/195 |
| 3,266,601 | 8/1966 | Taylor | 188/195 X |
| 3,386,533 | 6/1968 | Taylor et al. | 188/52 |
| 4,211,311 | 7/1980 | McMullen | 188/52 X |

OTHER PUBLICATIONS

Pages 617, 620 and 261, Car & Locomotive Cyclopedia, 1980, Pub. by Simmons-Boardman Pub. Corp.

*Primary Examiner*—Douglas C. Butler

*Attorney, Agent, or Firm*—McWilliams, Mann, Zummer and Sweeney

[57] ABSTRACT

A snap-on slide bearing for application to U-section formed sheet metal type guide lugs of unit brake beams for mounting the unit brake beams equipped with such guide lugs in the railroad car truck side frame unit brake beam guide brackets, preferably in place of the conventional spring steel wear plate now generally in use, comprising a one piece U-shaped clip member formed from spring steel and defining spaced apart superposed congruently related parallel arms integrally joined at like ends by abridging web, with the arms at their other ends being angled toward each other to define for each such arm a locating stop spaced from the clip member web approximately the length of the the guide lugs, and with the clip member arms each having affixed to the outer surfacing of same a strip that is preferably formed from a polymeric material, such as UHMW polyethylene, which strip is rectilinear and planar in outline, which strips are shaped and proportioned for substantially complemental but slidable seating in the side frame guide bracket in which the guide lug is to be mounted, when the slide bearing is mounted on the guide lug. The slide bearing for each guide lug snap fits thereon from the leading edging of same and extends across the lug to dispose the clip member stops against the guide lug trailing edging.

20 Claims, 12 Drawing Figures

SNAP-ON SLIDE BEARING FOR U-SECTION TYPE UNIT BRAKE BEAM GUIDE LUGS

This invention relates to a slide bearing for operably mounting unit brake beams of railroad car trucks, and more particularly, to a slide bearing adapted for application to the guide lugs of unit brake beams for slidably mounting the brake beam in the truck side frame guide brackets in the proper operating relation of the brake beam relative to the axle wheel to be braked by the brake shoes carried by same.

Unit brake beams conventionally include at their ends extensions in the form of a guide lug forming each extension for mounting the brake beam adjacent the wheels of a truck axle to be braked by the particular brake beam involved, in guide brackets (AAR standard S-366-79) that are ordinarily formed as an integral part of each truck side frame that is of the type to be equipped with unit brake beams, on the in-board side of same and to either side of the side frame spring seat on which the bolster supporting spring groups rest. In any given four wheeled truck, for instance, that is to mount unit brake beams, the truck side frames define on their in-board sides a first opposed pair of such guide brackets on one side of the bolster and a second opposed pair of such guide brackets on the other side of the bolster. The guide brackets on either side of the truck are oppositely and upwardly inclined in the indicated paired relationship, and the respective pairs of guide brackets are located to lie on a radius of the truck axle to be braked by the application of the unit brake beam thereto that is mounted in a given pair of opposed side frame unit brake beam guide brackets. AAR standards call for these brackets to be inclined to the horizontal at an angle of 14 degrees for 40, 50, 70, and 90–100 ton cars, and at an angle of 16 degrees for 125 ton cars.

In use, to mount the unit brake beam from the side frame guide brackets that are to support same, conventionally each guide bracket has applied to same a wear plate (AAR Standard S-367-78) formed from spring steel in a shape to overlie the upper and lower walls of the guide bracket in which the wear plate is mounted, and be snap fit applied to such bracket. Conventional practice involving unit brake beams in operative relation on the truck is to insert the brake beam guide lugs in an opposed set of such wear plate equipped guide brackets, with the unit brake beam shoes directed at the axle wheel to be braked. For the common two axle four wheel type truck, one brake beam is mounted in such guide brackets on one side of the truck bolster and the other brake beam is similarly mounted on the other side of the bolster, with the set of brake beams involved being suitably interconnected and actuated by suitable power means well known to the art to move the brake beams upwardly and away from the truck bolster to apply the brake shoes carried thereby against the truck wheels, as is well known to the art, and accommodate return of the brake beams to their retracted positions, helped by vibration and either under gravity, or by the power means employed, or both, depending on the type of equipment involved.

It is an established fact in the railroad field and uneven and undue wear of brake shoes, and even the unit brake beams themselves, is a costly and long standing maintenance problem for the railroads. One major railroad has advised that it has to spend something on the order of twelve and one-half million dollars each year to replace brake shoes in unit brake beams of which much has been attributed to uneven wear that required premature removal.

The basic problems involved and the successful solution therefor are the subject of the copending application of Richard F. Murphy, Ser. No. 376,823, filed May 12, 1982 (assigned to the same Assignee of the present application), which application reveals that the manner of conventionally mounting unit brake beams for operative movement in the indicated steel wear plate equipped guide brackets is a major cause of the undue and uneven wear problem. The steel wear plates only loosely receive the unit brake beam guide lugs, especially when worn, and since the wear plates are the only means provided to guide the movement of the unit brake beam involved for any given pair of brake beam guide brackets, the result is that the brake beam sag, brake shoes side downwardly, with the result that the upper ends of the brake beam shoes are subjected to excessive braking wear, and even tend to drag at their upper ends on the axle wheels they are to cooperate with, in the retracted positions of the brake beams. The looseness of the brake beam guide lug mounting in the guide bracket conventional wear plates is a necessity, however, if the brake beams involved are to move with any degree of freedom relative to their mounting brackets, as otherwise too much energy would be lost in the braking effort due to the binding and frictional engagement that the brake beam guide lugs are subjected to within their wear plates. Furthermore, as most brake equipment does not provide for powered return or retraction of the brakes, gravity and train movement vibration along the track rails is relied upon to return the brake beams to retracted relation. Thus, the loose or sloppy fit indicated is an absolute necessity for the brake beams to achieve return to something reasonably approaching their retracted positions as otherwise the brake beams would fail to return to their retracted positions so as to be adequately spaced from the axle wheels when the brakes are not operating.

The result is that the wear of unit brake beam brake shoes is commonly uneven, some times to the point where the upper portion of the brake beam head or heads also wears, which requires replacement of the unit brake beam itself. The sloppy fit of the unit brake beam guide lugs within their wear plate mountings, and the eccentric weight action thereon, that is presented by the weight of the brake beam heads and shoes, results in cocking of the guide lugs within their wear plate mounts, which in addition to the steel on steel static and sliding friction that must be overcome with regard to the engaging metallic surfaces that are involved, such metallic surfaces are subject to corrosion, and foreign material build ups, which result in undesirable loss of braking pressure, increased brake application time, and unreliable and often partial brake beam retraction, in addition to the uneven wear problem (that is frequently caused by poor retraction).

A further problem is that the truck side frame guide brackets themselves are subject to considerable wear due to the constant rubbing of the spring steel wear plate thereagainst in service, as the spring steel from which such wear plates are formed is harder than the grade B or C steel from which the truck side frames are conventionally formed, which further increases the aforementioned sloppy fit of the unit brake beam guide lugs within their wear plate mountings.

A principal object of the present invention is to provide a novel mounting arrangement for the guide lugs of unit brake beams that permits replacement of the conventional unsatisfactory but widely used spring steel wear plate with a polymeric material faced slide bearing that snap fits onto the guide lug whereby the brake beam is held and is guided by the guide brackets throughout the brake beam stroke for flush application of the brake shoes to the wheels, while providing for minimal power loss due to the actuation of the brakes and minimized brake application time requirement as well as full and easy return of the brake beams to their retracted positions.

Another principal object of the invention is to provide a simplified slide bearing device for unit brake beam guide lugs that permits elimination of the troublesome spring steel wear plate in favor of a polymeric material faced slide bearing of snap-on, U-shaped clip configuration, that is received on and about the brake beam guide lug for slidably mounting same in its brake beam guide bracket, which slide bearing has its upper and lower side surfacings defined by polymeric surfaces that are essentially wear free, fully corrosion resistant, and that are of dry self-lubricating characteristics, which, when the bearing device is applied to the side frame guide bracket that is to mount the end of the brake beam equipped with the guide lug in question, holds the brake beam guide lug it slidably mounts so that the brake beam and the guide lugs at either end of same are held in substantially coplanar relation with the radius of the axle that the side frame guide brackets are formed on, so that the brake beams move in a truly free manner on brake application and release, with the brake shoes being flush applied to the wheel rim or tread surfaces they are to frictionally engage during the course of the braking stroke.

Another important object of the invention is to provide a slide bearing of the type indicated that is proportioned to closely receive, and be snap fitted on, the unit brake beam guide lug it is to be applied to, for adapting the brake beam to be slidably mounted by its guide lugs for free sliding movement in its slide frame guide brackets for full flush application of the brake beam brake shoes to the axle wheel they are to engage.

Yet another important object of the invention is to provide a flexible, light weight, slide bearing arrangement of the type indicated that is in the nature of a spring steel U-shaped snap-on clip having its arms faced exteriorly with strips formed from a polymeric material of low coefficient friction characteristics for antifriction slide mounting of the brake beam guide lugs in their truck side frame guide brackets that is specifically adapted for application to a common type of brake beam guide lug arrangement in which the lug is of sheet metal U-shaped section defining a web portion that faces the respective side frames (of the truck in which the brake beam is mounted) and the upper and lower side flanges or side walls projecting from said web portion for connection to the brake beam main beam, in which the slide bearing closely receives the guide lug across the length of the latter, and is snap fitted in place from the leading edge of same and is mounted to securely hold the bearing on the guide lug during use, with the relatively rigid nature of the lug as applied to the brake beams serving as a mounting and rigifying core of the slide bearing mounted thereon.

Still other objects of the invention are to provide a slide bearing arrangement of the type indicated that requires no modification of the truck side frames or unit brake beams in use, that will provide for substantially uniform wear on the brake shoes and avoid the brake head wear problem in practice, that is economical of manufacture, convenient to apply both to the brake beam guide lugs and the side frame guide brackets, and that is essentially wear free in use.

In accordance with the invention, a flexible, light weight, snap-on type slide bearing for snap fit application to the guide lugs of unit brake beams is provided, for arranging the unit brake beams for application to the truck side frame unit brake beam guide brackets, preferably in place of the troublesome spring steel wear plates now in general use. The slide bearing of the instant application is specifically arranged for application to unit brake beam guide lugs of the conventional well known formed sheet metal type in which the lug is of U-section with the lug web portion being the part of the lug that faces the truck side frame of the guide bracket in which the lug is to be slidably mounted, and the lug upper and lower side walls or flanges project from the lug web portion and define spaced apart straps that are apertured for connection to the brake beam main beam. The slide bearing of the invention comprises a one piece, flexible, U-shaped, clip member formed from spring steel of film thickness dimensions, in the range of 1/16 to ⅛ inch, and defining spaced apart superposed congruently related parallel arms integrally joined at like ends by a bridging web, with the clip member arms at their other ends being angled toward each other to define for each arm a locating stop spaced from the clip member web approximately the length of the guide lug in question, and with the clip member arms each having affixed to their outer surfacings a strip formed from an ultra high molecular weight polymer, preferably polyethylene, or other suitable polymer of dry self lubricating characteristics that is of rectilinear outline and of flat or planar shaping, with the slide bearing being shaped and proportioned relative to the guide bracket slot it is to be applied in, and the guide lug it is to be applied to, such that the relatively flexible slide bearing in its operative position on, and including, the relatively rigid guide lug, are shaped and proportioned, as a unit, for substantially complemental but sliding fit seating of the slide bearing in the truck guide bracket therefor. The slide bearing is formed such that the clip member closely receives the unit brake beam guide lug to be mounted in same, in snap fit relation thereto, from the leading edging of same, whereby the slide bearing and the guide lug are essentially in coplanar, squared relation, and the slide bearing is held on the guide lug by the stops at the free ends of its arms engaging the trailing edging of same, whereby the lug serves as a rigid mounting core for the slide bearing.

When the brake beam having its indicated type guide lugs so equipped with the indicated slide bearings is mounted in its operative relation with respect to the truck side frame guide brackets that are to operatively mount same for movement toward and away from the axle wheels the brake beam is to cooperate with, the brake beam guide lugs are disposed and maintained in substantial coplanar alignment with the desired brake beam movement path radially of the axle wheels to be braked (on actuation of the brakes). The outer surfacings of the slide bearing polymeric strippings are uncoated, and are fully corrosion resistant, and have a coefficient of friction with respect to steel of about 0.15, while the inner surfacings of the slide bearing clip member are formed to closely receive the guide lug, for slidably mounting same, antifriction style, within the truck side frame guide bracket that is to operatively mount the guide lug in question.

Other objects, uses and advantages will become obvious or be apparent from a consideration of the following detailed description and the application drawings in which like reference numerals indicate like parts throughout the several views.

In the drawings:

FIG. 1 is a diagrammatic elevational view of the in-board side of a typical conventional four wheeled truck having unit brake beam equipment, with some parts being shown in phantom, and other conventional parts being omitted as irrelevant, and with the bolster, axles, and wheel being shown in outline, the view illustrating, diagrammatically only, the conventional manner of slidably mounting guide lugs of hangerless brake beams, in the side frame guide brackets , within the conventional spring steel wear plate with which each guide bracket is provided for this purpose, and in the manner in which the brake shoes are suppose to be presented to the wheel treads for braking;

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 1:
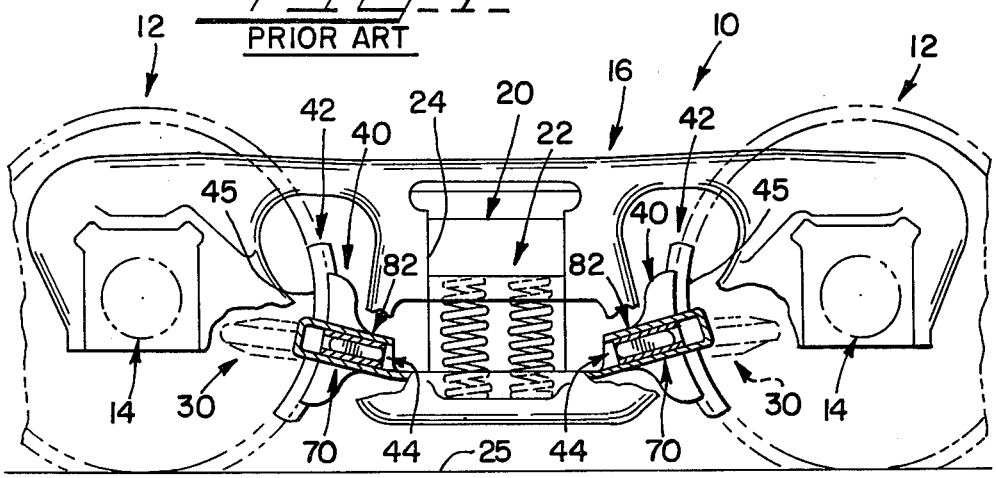
FIG. 1 PRIOR ART
Figure 3:
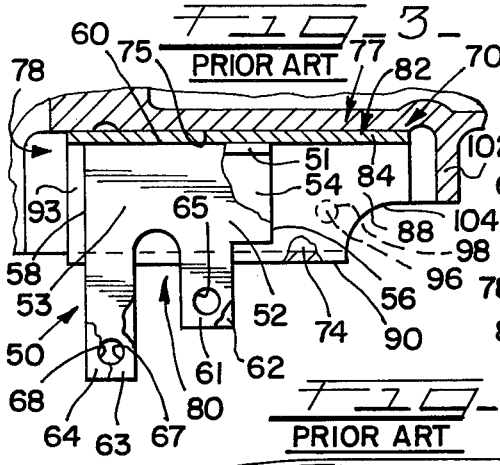
FIG. 3 PRIOR ART
FIG. 3 is a fragmental cross-sectional view taken substantially along line 3—3 of FIG. 2, showing substantially in plan another form of conventional brake beam guide lug that is of the type to which the slide bearing of this application is specifically adapted for application.
Figure 2:
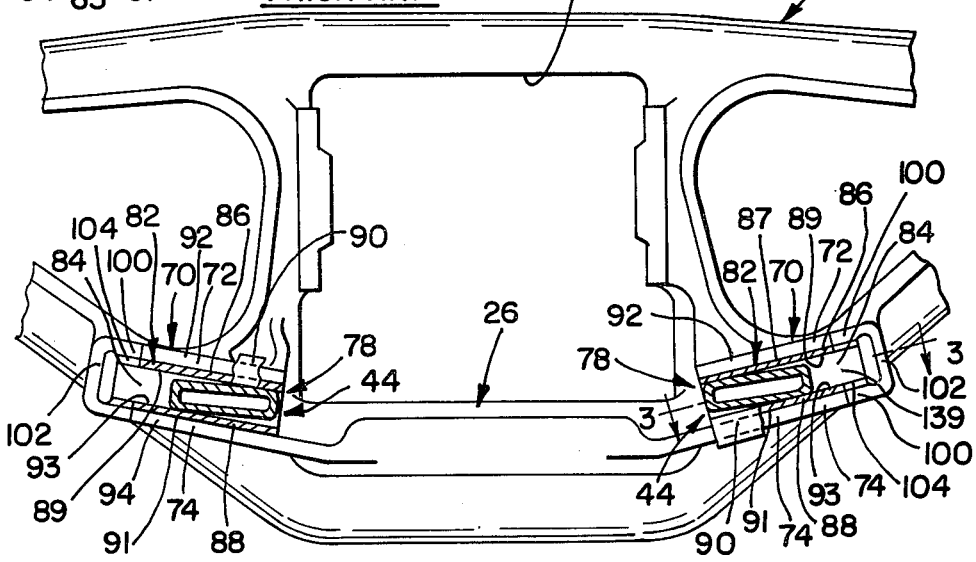
FIG. 2 PRIOR ART
FIG. 2 is an enlarged fragmental view of the in-board side of the truck frame shown in FIG. 1, better showing the conventional mounting arrangement of the unit brake beam guide lugs and the conventional truck side fram guide brackets and spring steel wear plates therefor, with this drawing figure illustrating one of the major problems presented by this conventional arrangement.

FIGS. 1–3 are provided primarily to make clear the structural environment to which the invention is applicable. The invention, as indicated, is concerned with the mounting of unit brake beams that for purposes of the invention may in and of themselves be of any conventional type having the formed sheet metal guide lug that is diagrammatically illustrated in FIG. 3, which represents the guide lug that the unit brake beam offered by Buffalo Brake Beam Company (of Buffalo, N.Y.) is equipped with (see page 617 of the Car & Locomotive Cyclopeadia for 1980, the disclosure of which is hereby incorporated herein by this reference). The arrangement of the truck, may, for example, follow the general arrangement illustrated in Taylor U.S. Pat. No. 3,266,601, with FIG. 1 of said Murphy application diagrammatically illustrating such a truck arrangement to make clear the nature of the conventional mounting arrangement of the unit brake beam and related parts, and that portion of the disclosure of said Murphy application is hereby incorporated herein by this reference.

Referring now more specifically to FIGS. 1–3 of the instant application, reference numeral 10 generally indicates a conventional railroad car truck that includes the usual wheels 12 mounted on the respective axles 14 with the ends of the axles 14 being suitably journalled in the opposed truck side frames that are identical in construction, one of which is indicated by reference numeral 16. The usual truck bolster 20 extends between the truck side frames 16 and has its opposite ends mounted on the usual spring groups 22 (see FIG. 1), that are received in the side frame windows 24 and that are seated on the respective side frame spring seats 26 in the usual manner, whereby the bolster 20 is isolated from the direct rail shocks encountered by the truck wheels 12 that are directly transmitted to the truck side frames 16. As is customary, the truck wheels ride on the usual rail 25, and two of such trucks are provided to support the conventional railroad car by the usual pivot connection to the bolster 20 at the bolster bowl (not shown), all as is well known in the art.

Conventional trucks 10 may be equipped with any suitable type of brake equipment of the unit brake type, the truck mounted package brake unit disclosed in said Taylor U.S. Pat. No. 3,266,601 being an example, and the disclosure of said Murphy application illustrated in FIGS. 1–4 thereof giving an example of such brake equipment may be referred to for suggestions as to the general arrangement of the unit brake beams, the conventional manner of mounting same between the truck side frames for application to the truck wheel tread surfaces, and power means for effecting the brake stroke including the brake levers and related and associated components. The invention is also equally applicable to the well known older and more common car body mounted braking system where hangerless brake beams are employed.

Figures 4, 6, 7, 8:
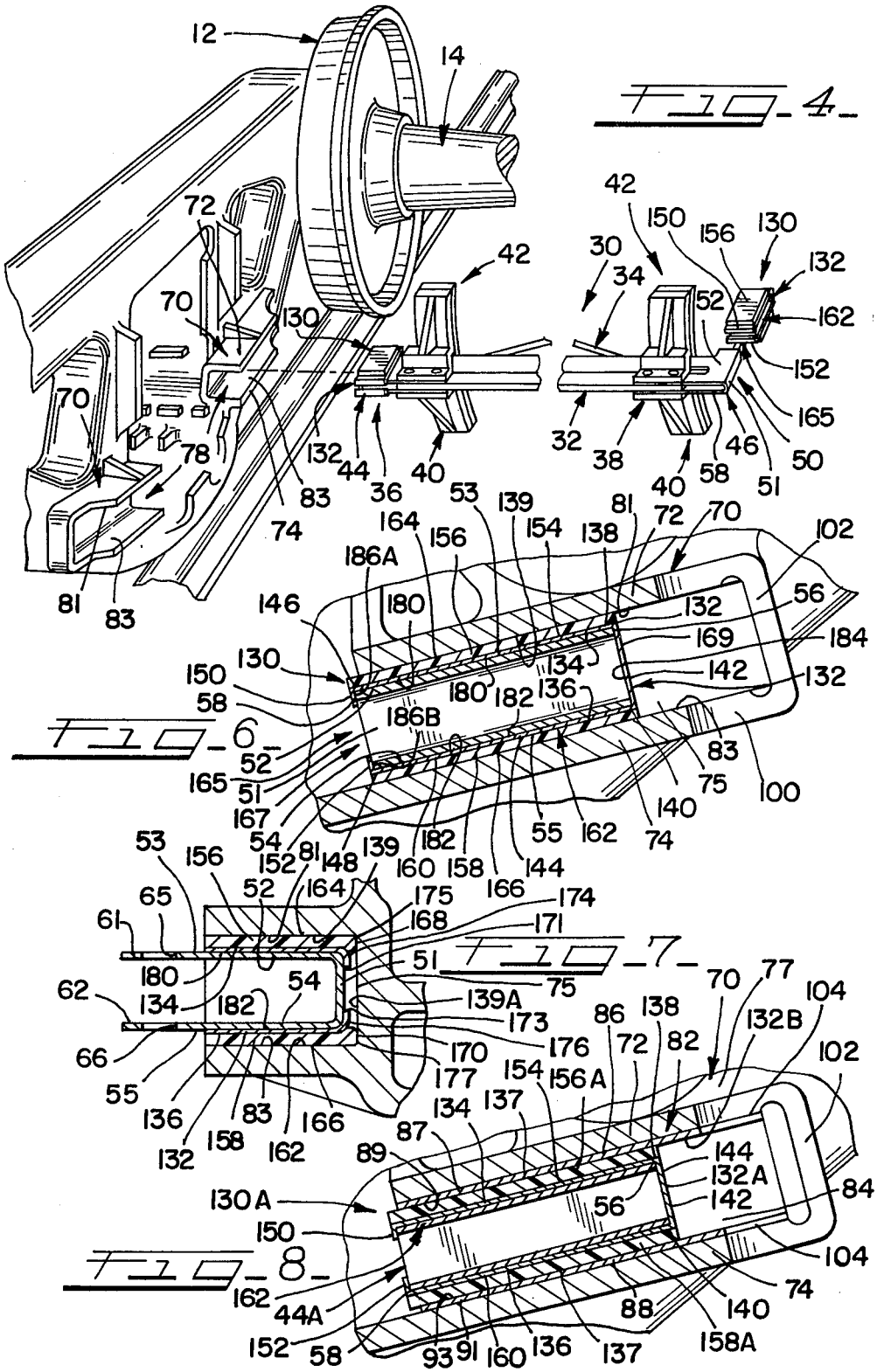
FIG. 4 is an exploded, fragmental, diagrammatic perspective view illustrating the general nature of the slide bearing arrangement of the present invention, its application to the brake beam guide lugs of the type indicated in FIG. 3, and a corresponding application of the slide bearings to the truck side frame guide brackets.
FIG. 6 is a fragmental sectional view taken substantially along line 6—6 of FIG. 5.
FIG. 7 is a fragmental cross-sectional view taken substantially along line 7—7 of FIG. 5.
FIG. 8 is a view similar to that of FIG. 5, but illustrating a modified embodiment.

For purposes of the disclosure of the present application, the brake beam indicated at 30 in FIG. 4 diagrammatically represents in a fragmental perspective view showing the aforementioned Buffalo unit brake beam, the center portion of which is omitted in the showing of FIG. 4 to permit both end portions to be illustrated, with the brake beam 30 generally comprising the familiar main beam 32 having truss member 34 suitably connected to and between the respective ends 36 and 38 of same, the usual center strut that is interposed between the apex of the truss 34 and the mid portion of the main beam 32 that are omitted in the showing of FIG. 4, and the usual familiar brake heads 40 at the main beam ends 36 and 38 that are equipped with the usual shoes 42 that are also shown in FIG. 1. In the showings of FIGS. 1 and 4 the brake ends 40 and their shoes 42 are indicated in largely block diagram form.

The brake beam 30 at its ends 36 and 38 includes the respective conventional formed sheet metal guide lugs 44 and 46 that are suitably secured thereto, as by employing suitable fasteners (not shown), such as rivets or the like. In the specific form illustrated, in FIGS. 1–8, the guide lugs 44 and 46 are affixed to the main beam 32 of brake beam 30 by rivets (not shown).

The guide lugs 44 and 46 of brake beam 30 are identical, and are shaped so that either guide lug 44 or 46 may be applied to either end of the main beam 32. As indicated by the showing of FIG. 3, guide lugs 44 and 46 typically comprise a generally flat or planar metallic body 50 of U-shaped sheet metal construction defining a web portion 51, upwardly facing side wall 52 having upper facing external surfacing 53, and downwardly facing side wall 54 having downwardly facing external surfacing 55, with these portions of the body 50 forming forwardly facing rectilinear side edging 56 that is of U-shaped configuration, rearwardly facing side edging 58 that is also of U-shaped configuration (see FIG. 4), and outwardly directed side edging 60 that is defined by web portion 51 and faces the truck side frame in the mounted relation of the brake beam 30. The guide lug side walls 52 and 54 of each such guide lug are shaped to define the respective relatively short strap portion 61 and 62 that are adjacent to but spaced rearwardly from the forward edging 56 in spaced apart congruent relation, and the respective relatively long strap portions 63 and 64 that are at the lug rear edging 58, which also are in spaced apart, congruent, relation. The strap portions 61 and 62 are formed to defined aligned apertures 65 and 66, respectively, and strap portions 63 and 64 are formed to define aligned apertures 67 and 68, respectively, to respectively receive the fasteners employed to fix the respective lugs 44 and 46 to the brake beam main beam 32 following conventional practices.

The guide lugs 44 and 46 in practice are generally flat or planar in block diagram configuration, and their strap portions 63 and 64 in some embodiments have a second set of apertures aligned with the apertures of the strap portions 61 and 62 for additional securement of the respective lugs to the main beam 32. In any event, it is conventional practice to mount the brake beams 30, as equipped with such guide lugs 44 and 46, in their opposed relations (diagrammatically illustrated in FIG. 1) by slidably mounting guide lugs 44 and 46 thereof in between opposed pairs of the conventional guide brackets 70 that are located at the inboard side of the respective truck side frames 16. As indicated in FIGS. 1–4, the guide brackets 70 conventionally are an integral part of the side frame 16 and comprise an upper wall or ledge 72 that is spaced above and parallels the lower ledge or wall 74, which walls 72 and 74 project from the side frame basic wall structure 77 that in the area of brackets 70 is shaped as diagrammatically indicated in FIGS. 2–7. The ledges or walls 72 and 74 are spaced apart by floor or basic wall 75, and these walls define as part of the side frame wall structure 77 a planar slot 78 that is open as at 80 to receive the aforementioned conventional spring steel wear plate 82. The walls or ledges 72 and 74 each define confronting inner surfaces 81 and 83 that with floor 75 form slot 78. Wear plate 82 is of U-shaped transverse cross-sectional configuration, it being formed from spring steel sheet material of three sixteenths inch thickness by a suitable processing to define web portion 84 and spaced apart upstanding side walls 86 and 88, surmounted, respectively, by the respective laterally extending edges 90 (see FIG. 2) that lie against the guide bracket wall planar end surfaces 92 and 94 when the wear plate 82 is in its operating position (only fragments of ledges 90 are shown in FIG. 2). The wear plate side walls 86 and 88 conventionally are each formed to define at their outer surfaces 87 and 91 a pair of outwardly extending protuberances 96 (only one is shown in FIG. 3) that are intended to lodge in conventional pairs of securement apertures 98 that are formed in the respective walls 72 and 74, as suggested by the showing of FIG. 3. The wear plate walls 86 and 88 have a free standing relation to diverge outwardly of the wear plate web portion 84 at a suitable flat angle, so that when the wear plate is force fitted into the slot 78, its side walls 86 and 88 will be bent towards each other to dispose them, and specifically, their inner surfaces 89 and 93, in substantial parallelism, as indicated by the diagrammatic showings of FIGS. 1–3.

The guide bracket walls 72 and 74 at the upper ends of same are formed to define concavely arced corners 100 from which they extend upwardly to integrally unite with the short end wall 102 that forms the upper end of the slot 78. The conventional wear plate side walls 86 and 88 are similarly shaped to conform to the concave corners 100, as at 104 (see FIG. 2).

As indicated by the larger scale showing of FIG. 2, conventional practice is that the side walls 86 and 88 of the conventional wear plate 82, when the latter is mounted in its operating position, are spaced apart a distance that, because of the sliding, metal to metal relationships involved, has to exceed the thickness of the unit brake beam guide lugs 44 and 46 that are to be slidably mounted within the slots 78 and between the side walls 86 and 88 of the wear plate 82. The arrangement of the brake beams and the parts they carry is such that the beams are eccentrically weighted whereby any looseness of the fit of the brake beam guide lugs within the guide brackets 70 results in the brake beams tending to sag downwardly at their upper ends, with the brake beam guide lugs thus becoming angled or cocked with respect to the slots 78, and the upper ends of the brake shoes being disposed too close to the wheel treads they are to engage, such that in extreme cases, in the retracted position of the brake beams, the shoes will drag at their upper ends on the wheeled treads involved. It is apparent that on actuation of the brake equipment with the brake beams so angled, the brake beam brake shoes will not be applied flush against the wheel treads. The guide brackets 70 are conventionally formed to lie on a radius of the axle wheel that the brake beam as mounted thereon is to serve, which is one of the indicated angulations to the horizontal that has been mentioned. Unit brake beams are conventionally designed so that when they, and especially their guide lugs 44 and 46 are coplanar with the plane in this radius longitudinally of the axle to be serviced by the brake beam, as indicated by the block diagram type showing of FIG. 1, the brake shoes 42 will be applied flush against the wheel treads when the braking forces are applied.

However, standard practices require the loose or sloppy fit of the brake beam guide lugs 44 and 46 within the wear plates 82 because both the wear plates 82 and the guide lugs 44 and 46 are subject to corrosion and must be proportioned to have the loose fit that is indicated in FIG. 2, which is needed to insure some sort of freedom of movement to permit the brake applying action that is desired in accordance with standard practices. This looseness of fit and the brake sag that results from same worsens as the parts involved wear in service, due to the metal to metal sliding action that is involved. Furthermore, the slots 78 tend to fill up with debris, moisture, and in winter, ice and snow, which tends to clog the freedom of movement of the brake beam guide lugs 44 and 46, occasionally resulting in jamming of the components involved and other problems resulting in loss of brake pressure.

In the showing of FIGS. 1 and 2, lugs 44 and 46 are indicated in block diagram form only, with the specifics of the conventional guide lug type to which the invention of this application is applicable being shown in FIGS. 3–8.

In the specific type of conventional brake beam guide lugs 44 and 46 that is illustrated in the drawing FIGS. 3–8, the guide lug body lower side wall 54 is intended to be slidably supported on the wear plate side wall 88, and the upper guide lug side wall 52 is intended to be free of compressive loading, even though in practice the positional relationships illustrated in FIG. 2 take place in the mounting of the unit brake beam guide lugs 44 and 46 within the side frame guide brackets 70.

Conventionally, side walls 72 and 74 of brackets 70 are formed to be apart a nominal two inches with a tolerance range of plus 2/32 inch and minus zero inch (the distance between their surfaces 81 and 83). Guide lugs 44 and 46 are conventionally made to have a nominal length of 4.5 inches between their side edgings 56 and 58, and to have a breadth or depth (the dimension separating their respective side wall surfacings 52 and 54) that is 1.5 inches with a tolerance range of plus zero and minus 1/16 inch (or 1 and 7/16) (1.4375) inches (AAR standard S-345-79). Wear plates 82 are formed so that when they are force fitted into a slot 78, their side wall inner surfaces 89 and 93 will be in substantial parallelism and spaced apart a nominal one and ⅝th (1.625) inches. The guide lugs 44 and 46 as conventionally applied to unit brake beams and mounted in wear plates 82 are disposed in the wear plates 82 so that their web portions 51 are spaced from the wear plate web portion 84 approximately ⅜ of an inch.

Referring now more specifically to FIGS. 4–7, in accordance with the present invention, the unit brake beam guide lugs 44 and 46, in the form illustrated in FIG. 3, are each equipped with a slide bearing 130 of special construction that is provided for slidably mounting the unit brake beam guide lugs 44 and 46 and guide brackets 70, and specifically within the slots 78 they define, without the side frame guide brackets 70 or the unit brake beams 30 having to be modified in any way. In the embodiment of FIGS. 4–7, the slide bearings 130 replace the troublesome wear plates 82, while in the variant form of FIG. 8, the slide bearing 130A there illustrated and the associated guide lugs 44 and 46 (represented in FIG. 8 by guide lug 44A) are proportioned for slidably mounting the unit brake beam 30 involved in the conventional wear plates 82.

Referring first to the specifics of slide bearing 130, it comprises a one piece U-shaped clip member 132 formed from spring steel and serving as the skeletal backbone of slide bearing 130. Clip member 132 is formed to define spaced apart, substantially parallel and congruently related arms 134 and 136 that are integrally connected at their like ends 138 and 140, respectively, by bridging web 142. Clip member 132 is, as indicated, of one piece construction in the form of a strip or length 144 of spring steel of film thickness dimensions, in the range of from about 1/16 inch to about ⅛ inch, and shaped as indicated, with the other like ends 146 and 148 of arms 134 and 136, respectively, being angled toward each other to define oppositely directed stop lugs 150 and 152 (see FIG. 6).

Clip member 132 has fixed to the exterior surfacing 154 of its arm 134 polymeric stripping 156, and a similar stripping 158 is affixed to the external surfacing 160 of its arm 136. The clip member arms 134 and 136 and its web 142 define a pocket 162 in which the lugs 44 or 46 are received in applying the slide bearing 130 thereto. Slide bearings 130, in accordance with the invention, are applied to the respective lugs 44 and 46 by slipping the slide bearing 130 involved onto the lug in question from the forward edging 56 of the guide lug in question, with the stops 150 and 152 being separated as needed for this purpose by flexing clip member arms 134 and 136 away from each other, so that the slide bearing arms 134 and 136 may be eased across the length of the guide lug in question (exteriorly thereof), with the stops 150 and 152 sliding or riding along the upper and lower exterior surfacings of same, until the stops 150 and 152 reach and snap behind the rear edging 58 of the guide lug in question, whereby the mounted position of FIGS. 4–7 is achieved. For this purpose, the slide bearing 130 has a width dimension transversely of its arms 134, 136, and web 142 that substantially complements the depth of the guide bracket slot 78 (see FIGS. 5 and 7), and the stops 150 and 152 are spaced from the clip member web 142 a dimension substantially approximating the length of the lugs 144 and 146 between its edgings 56 and 58.

Strippings 156 and 158 are preferably formed from a polymeric material that in the preferred form is ultra high molecular weight (UHMW) polyethylene having a molecular weight in the range of from about three million to about nine million. They are suitably affixed to the respective arms 134 and 136, as by being formed or molded in place thereon, or as by being bonded thereto using a suitable bonding material considering the nature of the polyethylene material involved.

In accordance with the invention, the slide bearing clip member 132 and the strippings 156 and 158 are shaped and proportioned such that the slide bearing 130, as applied to a guide lug 44 or guide lug 46, has complementary fit, but free slip fit, reciprocatory seating relation, within the guide slots 78 of the respective guide brackets 70, and specifically with respect to bracket internal surfacing 139 (which is defined by ledge inner surfaces 81 and 83 and base 75) when the guide lugs 44 and 46 as so equipped with the slide bearings 130 are applied thereto. The result is that the external surfacings 164 and 166 of the respective strippings 156 and 158 are in substantial complementary, but free sliding relation, with the side surfaces 81 and 83 of internal surfacing 139 of the respective guide brackets 70 (that the bearings 130 and the lugs 44 and 46 they are applied to, and thus the bearings 130 are in substantial complemental but free sliding fit relation with and within the respective slots 78. In practice the proportioning of the slide bearings 130 is such that as applied to lugs 44 and 46 of standard AAR thickness, they should fit in the 2 inch slots 78 with an approximate 1/32 inch tolerance, and body 132 fits in the 2 3/32 slot 78 with an approximate ⅛ inch tolerance, with respect to the corresponding surface portions 81 and 83 of bracket internal surfacing 139 of such slots. The stripping external side surfaces 164 and 166 are essentially planar in configuration and smooth in the sense of being free of surface roughness, porosity, scaling, pitting, or the like; they are also uncoated to fully expose the polymeric material involved, and be in the antifriction, slip fit, relation with the bracket surfaces 81 and 83 that is contemplated by the present invention.

As indicated in FIG. 7, strippings 156 and 158 at their respective edges 168 and 170 are extended beyond the guide lug edging 60 for presenting their respective edging surfaces 175 and 177 for riding engagement with the guide bracket base 75, and thus with the web 139A of guide bracket internal surfacing 139, to space the guide lug webs 51 therefrom. For this purpose, the clip member arms 134 and 136 have their respective edges 171 and 173 angled toward each other, as indicated at 174 and 176 (see FIG. 7) to preclude the slide bearing 130 from allowing the lug web portion 51 to ride on the web surface 139A of the guide bracket 70 to which the slide bearing 130 is applied.

Figure 5:
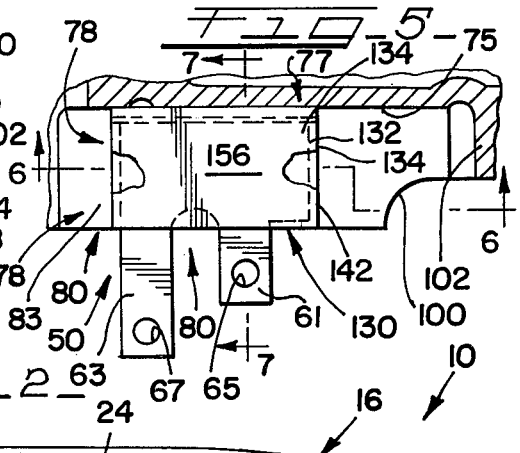
FIG. 5 is a view similar to that of FIG. 3, but with the slide bearing of this invention applied to the guide lug shown in FIG. 3 and the truck frame guide bracket in replacement of the conventional spring steel wear plate.

The arms 134 and 136 of the clip member 132 are spaced apart to define the clip member inside wall surfacings 180 and 182 that are spaced apart to closely receive the respective guide lug upper and lower side walls 52 and 54 in substantial complementary relation to same, while the clip member web 142 and stops 150 and 152 define inside surfacings 184 and 186A and 186B, respectively, that closely receive the guide lug side edgings 56 and 58, in substantially complementary relation thereto, with these members being shaped and proportioned such that when a slide bearing 130 is applied to the respective guide lugs 44 and 46 of standard AAR size (having the specifics shown in FIGS. 3–7), as by sliding a clip member 132 onto the guide lug 44 or 46 in question from its forward edging 56 to its rearward edging 58 for its snap fit relation thereon in the manner already indicated, the guide lug 44 or 46 as fully received in the slide bearing 130 in question is squarely mounted relative to the slide bearing 130 (as indicated in FIGS. 5, 6 and 7).

Thus, the slide bearings 130 define a U-shaped bearing structure that is open as at 165 to receive the guide lug 44 or 46 on which same is to be mounted; as indicated by FIGS. 4–7, the slide bearing 130 is generally of a rectilinear outline, and of channel shaped configuration in cross-sectional configuration longitudinally of the clip member 132. Slide bearing 130 thus has open end 167 and a closed end 169 at web portion 142.

The unit brake beam 30 as equipped with the slide bearings 130 at either end of same may then be applied to the respective guide brackets 70, leaving off entirely the spring steel liners 82, which are replaced by the bearings 130. The brake beam guide lugs 44 and 46 of a brake beam 30 so equipped are inserted one at a time from the end wall 102 end of the brackets 70, with one guide lug mounted bearing 130 being inserted into a guide bracket slot 78 of one of the guide brackets 70 to mount same, and then the brake beam other guide lug mounted bearing 130 is similarly applied to the opposing guide bracket slot 78. When both unit brake beams have their guide lugs 44 and 46 mounted in the bracket slots 78 in the manner indicated in FIGS. 5–7, the unit brake beams 30 may be connected in any suitable manner to complete the assembly of the brake equipment in accordance with standard technology and know how of this subject.

Where new brake equipment is involved, the bearings 130 are applied in the manner indicated, to the truck brackets 70 involved, at the appropriate stage in the assembly of the brake equipment.

Thus, the unit brake beam guide lugs 44 and 46 are shiftably mounted within the respective truck guide brackets 70, in accordance with the invention, by the bearings 130 mounted thereon respectively being inserted in the respective slots 78 that are defined by the bracket side walls 72 and 74; the bearings 130 are in substantially complementary, close fitting, face to face, sliding contact and load bearing relation with and between the guide bracket side walls 72 and 74, and specifically, the bearing respective smooth, planar, antifriction, wear resistant, and corrosion free external surfaces 164 and 166, are in such contact and load bearing relation with guide bracket surfaces 81 and 83, as indicated in FIGS. 6 and 7. FIGS. 5–7 illustrate the manner in which the guide bearing 130 of all the unit brake beams 30 for a particular truck arrangement 10 are mounted for operation within the conventional guide brackets 70, and specifically within the slots 78, thereof, in replacement of the troublesome wear plates 82.

In connection with the mounting of the bearings 130 within the guide bracket slots 78, the guide bearing clip member 132, and its strippings 156 and 158, are proportioned to provide, as applied to the AAR standard size guide lugs 44 or 46, and mounted in a particular guide bracket 70, the indicated clearance or tolerance between the respective surfacings 81 and 83, which is as close as practical to the slot width of brackets 70 having their slots 78 lying in the AAR standard width range of from 2.000 inches to 2 and 3/32 (2.09375) inches, to achieve the substantially complementary but freely sliding, slip fit, substantially face to face sliding load bearing contact relation, of the bearing 130 within the bracket slot 78 that is contemplated by the present invention, and as illustrated in FIGS. 5–7, having in mind the need to accommodate the usual tolerance variations in this field. Bearing in mind the conventional AAR prescribed spacing between guide bracket side wall surfaces 81 and 83 of 2.0000–2 and 3/32 (2.09375) inches, the bearing 130, between its external side surfaces 164 and 166, and as mounted on the respective guide lugs 44 and 46, should have a width or depth dimension between such surfaces 164 and 166 that ranges between 1.96875 (1 31/32) inch and 1.9375 (1 15/16) inch, for a clearance between the guide bracket wall surfaces 81 and 83 that ranges between the indicated 1/32 (0.03125) inch and the indicated ⅛ (0.125) inch, to hold the relationship of parts shown in FIGS. 6 and 7. This complemental fit should be for the nominal length (4.5 inches) of the lugs 44 and 46, and for this purpose strippings 156 and 158 have a length that at least equals that of the guide lugs (see FIG. 6). The inside surfacings 180 and 182 of the clip member 132 are spaced apart relative to the guide lugs 44 and 46 (having the indicated AAR standard thickness) to closely receive such guide lugs therebetween with at least a proportionately similar tolerance range.

Thus, the complemental fit of the bearing 130 within the guide bracket slots 78, for the length of lugs 44 and 46, contemplated by this invention, which, together with the fit of the respective guide lugs 44 and 46 within the respective clip members 132, maintains the brake shoes for flush application to the wheel treads they service, involves the clip member 132 fitting in the slot 78 with a clearance in the range of from 1/32 (0.03125) inch to ⅛ (0.125) inch. This complemental fit insures ready application of the bearing 130 to the slots 78, with the bearing 130 (assuming again the AAR standard brackets 70), drooping or angling in the slots 78 under the eccentric loads on the brake beam at an angle approximating zero degrees and fifteen minutes for bearing 130 as applied to the 2 inch wide slot 78. Application of the bearings 130 to the 2 3/32 inch wide slot 78 will result in an angle of droop approximating one degree. The fit of the guide lugs 44 and 46 within the bearing clip members 132 should be with proportionately smimilar tolerances, so that the angle of inclination or droop of the brake beam 30 from coplanar positioning relative to the plane of the slots 78 mounting same is no more than about two degrees even for the 2 3/32 inch slots 78.

Where the guide lugs 44 and 46 are over the AAR standard size in thickness, they should be ground to that standard size thickness for application to a bearing 130, as indicated by the AAR measuring gauge for such lugs (AAR standard S-360-79) that is commonly used for checking out guide lug dimensioning relative to the indicated AAR size standard for insuring compliance. Where the guide lug is under the AAR standard size thickness, it should be rejected.

Under gravity the bearings 130 rest on the bearing bracket side wall 72 or 74 that is disposed on the underside of the bearing 130 as mounted in its operating position in a particular truck guide bracket 70, with the bearing upper facing or side 81 bearing against the bracket side wall 72 or 74 that is disposed at the upper side of the bearing 130 as mounted, due to the eccentric loadings on the unit brake beams that the respective lugs 44 and 46 support. For slide bearings 130 on the side of the bolster illustrated in FIGS. 5–7, the bearing clip member arm 136 is at the lower side of the bearing, and for bearings 130 mounted on the other side of the bolster, the bearing clip member arm 134 is on the underside of the bearing. In any event, the guide lugs 44 and 46 of a particular unit brake beam, whether at rest or in motion, are held in essentially substantially coplanar relation with the plane of the axle radius along which the guide bracket slots 78, and thus the bearings 132, lie, and thus the unit brake beam brake shoes, for instance brake shoes 42, are held for application to the respective wheel treads 56, in accordance with the practice of the invention, in approximately the indicated flush application, by way of the complemental fit of the bearing bodies 130 within bracket slots 78 that is contemplated by this invention.

Thus, with the proportioning of parts of the slide bearing 130 relative to the internal configuration of the guide bracket slots 78 being in the complementary but sliding fit proportioning indicated, and the fit of the guide lugs 44 and 46 within bearings 130 being in the corresponding proportion indicated, the unit brake beams 30 will then be mounted in their respective guide brackets 70 approximately with the correct brake shoe flush fit application relationship indicated in FIG. 1, rather than the sloppy fit relation indicated in FIG. 2 that has been so much of a problem in accordance with prior art practices.

Once the slide bearings 130 of a particular unit brake beam 30 as mounted on a particular AAR standard size guide lug 44 or 46, are slidably mounted in their respective guide brackets 70, the bearing clip member arms 134 and 136 are held to the substantially parallel relation indicated in FIGS. 5–7 by the underlying guide lug and the corresponding substantially parallel relation of guide bracket side walls 72 and 74. This also insures that the slide bearings 130 remain seated on the respective guide lugs 44 and 46, free of mechanical fasteners. When the brake beams 30 are separated from their guide brackets 70, their bearings 130 may be pressed or pried off the respective guide lugs 44 and 46 if so desired, for inspection purposes or the like.

In other words, once the slide bearings 130 of a particular unit brake beam 30, as applied to the guide lugs 44 and 46 thereof, are slidably mounted in the respective guide brackets 70, the strippings 156 and 158 are disposed in substantially parallel complementary fit, relation to the guide bracket walls 72 and 74, but in smooth sliding relation thereto longitudinally of the slots 78. In this connection, once a slide bearing 130 is snap fit applied to a guide lug 44 or 46 in the manner indicated, the respective guide lugs 44 and 46 in effect serve, respectively, as a rigid mounting core for the bearing 130 that is applied to same, whereby in operation, the clip member 132 and its strippings 156 and 158 are maintained in the indicated complementary fit relation within the slot 78.

In the embodiment of FIG. 8, the slide bearing 130A and the guide lugs of the brake beam, one of which is shown at 44A, are proportioned to both received within the conventional spring steel wear plate 82 as the latter is normally mounted within the guide brackets 70, for each of the truck side frames in question, with the bearing clip member 132A and its strippings 156A and 158A being proportioned relative to the wear plate internal surfacing 139B to have surfacings 164A and 166A in the substantially complementing, face to face, but slip fit, free sliding relation relative to wear plate surfacing 139B when the wear plate 82 is conventionally mounted in its guide bracket 70, that is contemplated by this invention. Other structural features of the guide lug 44A and slide bearing 130A are the same, as indicated by corresponding reference numerals.

The ultra high molecular weight polyethylene indicated is available from several sources; one source is the molecularly oriented UHMW polyethylene marketed by Keltrol Enterprises of York, Pa. under the trademark TUFLAR (Grade PL), while another is the high I.V. (intrinsic viscosity) UHMW polyethylene marketed by Industries PPD Inc. of Sherbrooke, Quebec, Canada.

The ultra high molecular weight polyethylene material of the type indicated is a high density polymer of dry self lubricating characteristics that is sufficiently compaction resistant to resist any substantial compaction under compressive forces up to its elastic limit, and has a high degree of elastic memory for full return to original free standing shape after being stressed, up to its elastic limit. This material also has a high degree of toughness and long wearing characteristics, and is also receptive to fillers in the form of glass, clay, sand, suitable fabrics, and alumina, for modifying same to adapt the slide bearing body for special conditions.

The polyethylene material from which the slide bearing strippings 156 and 158 (and 156A and 158A) of this invention are made is also resiliently flexible, but nonstretchable, and is thus free from distending or stretching characteristics. The material indicated also has a coefficient of sliding or dynamic friction with respect to steel of about 0.15, whereby when the slide bearings disclosed herein, as applied to the relatively rigid guide lugs 44 and 46, are operatively mounted within guide brackets 70, the brake beams 30 are not only properly held during their power and retraction strokes in the right relationships to bring the brake beam shoes into flush frictional relation with the axle wheels they are to service, but the brake beams 30 are in free sliding relation with respect to the truck frame guide brackets 70 that operatively mount same.

Alternately, the slide bearing strippings 156, 156A, 158 and 158A may be formed from other polymers and plastic materials, such as nylon or Nylatron, the latter being a molybdenum disulphide filled nylon product made and sold by The Polymer Corporation of Reading, Pennsylvania. Polyurethane, Delrin, high molecular weight polyethylene, or General Electric Company's polycarbonate product sold under the trademark LEXAN, may also be employed to make the body forming the slide bearing in question. The non-UHMW plastic materials suggested are available from Evans Tool and Manufacturing Inc. of Aurora, Ill. However, the ultra high molecular weight polyethylene material having the characteristics indicated is preferred because of its particular suitability for the purposes of the present invention.

It will thus be seen that in trucks 10 that have their guide brackets 70 equipped with the slide bearings 130 or 130A, on each side of the truck bolster, the unit brake beam 30 or its equivalent, with which the truck 10 is equipped, as herein disclosed, will be disposed and guided in substantial alignment with the plane of the axle radius on which the pair of opposed guide brackets 70 for the specific unit brake beam involved lie, with their guide lugs 44 and 46 being held and operating in close proximity to true coplanar relation with the respective slots 78 between which the brake beam in question is mounted. The unit brake beams 30 or their equivalents will thus be held in close proximity to the theoretically desirable position diagrammatically illustrated in FIG. 1 in which the wear surfaces 45 of the brake shoes 42 will be presented substantially flush against the wheel treads they are to be applied against; in other words, the upper and lower portions of the brake shoe wear surfaces 45 involved will be applied substantially simultaneously against the wheel treads being braked on application of the braking pressure.

Furthermore, the action of the brake beam guide lugs 44 and 46 in moving toward and away from the braking position along the slots 78 defined by the respective guide brackets 70 is truly free and easy in view of the antifriction characteristics provided by the slide bearing external surfacings 164 and 166 (or 164A and 166A), with the brake beam guide lugs 44 and 46 remaining substantially in coplanar relation with the indicated radial plane of operation of the brake beams, respectively, along the indicated radius of the respective axles being braked, and for a useful life that can reasonably be expected to outlast the truck bolster and side frames.

In use, as the guide lugs 44 and 46 with the slide bearings 130 mounted on same, respectively, are repeatedly moved with respect to the guide brackets 70 in the case of the embodiments of FIGS. 4–7, the external surfacings 164, 166, 175, and 177 of the slide bearings 130 effect a polishing or honing resurfacing action on the corresponding portions of surfacing 139 (of the guide brackets 70), engaged thereby, such that after a period of normal use, the upper, lower, and web surfacings 81, 83 and 75 of the guide brackets 70 in question, instead of being worn, tend to be resurfaced so as to be effectively resistant against further wear, further reducing the coefficient of friction between the slide bearings carried by the respective guide lugs and the corresponding walls of the guide brackets 70 in question. The same effect occurs in connection with the embodiment of FIG. 8 with regard to the corresponding surfaces of the steel wear plate side walls 86 and 88 and its web 84. What appears to happen is that as the slide bearings involved move longitudinally of the slideways defined by the guide brackets 70, the polymer material that forms the bearing external surfacings 164, 166, 175 and 177 tends to fill up the pores and level the irregularities of the metal surfacing forming the slots 78 of guide brackets 70, and in the case of the embodiment of FIG. 8, the inside surfacing 139B of spring steel wear plate 82, such that such surfaces become partially reformed and defined by the transferred polymer material from the slide bearing external surfacings involved.

Foreign matter that is caught between the slide bearings and the metallic surfaces the slide bearing external surfacings cooperate with becomes embedded in the slide bearing strippings involved, and thus is positioned to avoid wearing engagement with the metallic surfaces the slide bearings cooperate with. Further, as such foreign matter becomes embedded in the bearing strippings, the thickness of the strippings tends to correspondingly enlarge, thus providing a self compensating effect making up for such wear or attrition on the bearing stripping surfacing as may be due to the aforementioned resurfacing action.

The slide bearings involved being formed from the indicated dry self lubricating material, the need for applying separate lubricating materials in this area is avoided, thereby permitting the truck guide brackets and associated parts to be free of wet type lubricants that would otherwise be employed for this purpose, which commonly accumulate foreign matter that aggravates wear problems. The preferred polymeric material employed in the practice of the invention also resists adherence thereto of foreign matter which thus will not accumulate where it could adversely affect the free and easy sliding action longitudinally of the guide brackets that is provided by the slide bearings of the present invention. It has also been found that the bearing external surfacings 164, 166, 175 and 177 tend to harden in use, thus increasing the ability of this surface to resist wear and this is also true of the polymeric material that is transferred to the corresponding guide bracket wall surfacings, or the corresponding wall surfacings of the spring steel wear liner 82, as the case may be.

The result is that wear at the guide lugs 44 and 46, slide bearings 130, and 130A, and the corresponding surfacings of the guide brackets or steel liners that they cooperate with is eliminated, whereby an essentially wear free mounting of the unit brake beams in the truck guide brackets is provided in which the aforementioned critical clearance range is maintained for the useful life of the guide lug slide mounting provided, which can reasonably be expected to exceed the useful life of the truck bolster and side frames.

The surfacings 164, 166, 175 and 177 of the slide bearings hereindisclosed, when such bearings are in their operating positions, serve as cam followers acting in a rectilinear manner following the cam surfacings defined by the walls 72 and 74 of guide brackets 70, and in the case of the embodiment of FIG. 8, the corresponding walls 86 and 88 of the spring steel wear plate 82. This functioning is provided by the relatively rigid nature of the guide lugs 44 and 46 that mount the bearings 130 or 130A.

The smooth shifting action provided by the application of the invention to unit brake beams and guide brackets therefor of the type indicated permits maximum application of the braking energy involved in a braking operation to the truck wheel treads, as distinguished from the substantial losses of same that heretofore have been needed to overcome the highly frictional engagement of the brake beam guide lugs or extensions with the conventional spring steel wear plate 82.

The tendency of snow or ice to pack in the area of the guide brackets 70 is substantially reduced or eliminated due to the non-porous nature of the polymeric material forming the slide bearings involved and its resistance to adherence thereto of foreign materials, as well as the surfacing action provided thereby on the metallic surfaces of the guide brackets involved, or in the case of the embodiment of FIG. 8, the spring steel liner involved, which resurfacing provides similar benefits to the resurfaced surfaces. Heretofore the compacting of snow and ice in the space defined by the prior art spring steel wear plate 82 has been a common cause of jamming of the brake beams in their guide brackets and loss of brake pressure.

The time for full brake application and full release of the brakes, of the brake equipment equipped with the guide bearings 130 and 130A of this invention, is substantially reduced due to the free and easy sliding movement that the brake beam guide lugs have within their mounting slotways defined by the guide brackets involved, which become permanently lubricated by the resurfacing action involved and require no further attention even though no conventional liquid type lubricant is involved.

The application of the invention to brake rigging of caboose cars has an especially significant advantage as the slide bearings of this invention act as sound deadeners, as distinguished from the rather noisy action of the metallic unit brake beam guide lugs operating within the conventional spring steel wear plates 82, applied as indicated in FIG. 2, and thus without the benefit of the slide bearings of the present invention.

Figure 9:
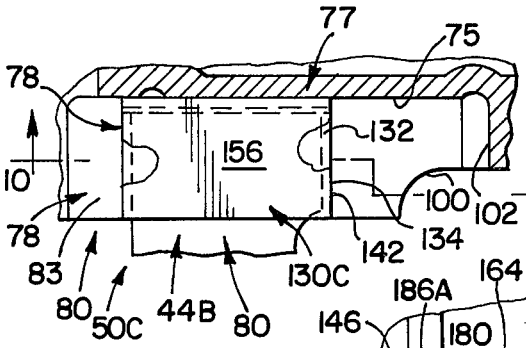
FIGS. 9, 10, 11 and 12 are similar to FIGS. 5 and 6, respectfully illustrating further embodiments.
Figure 10:
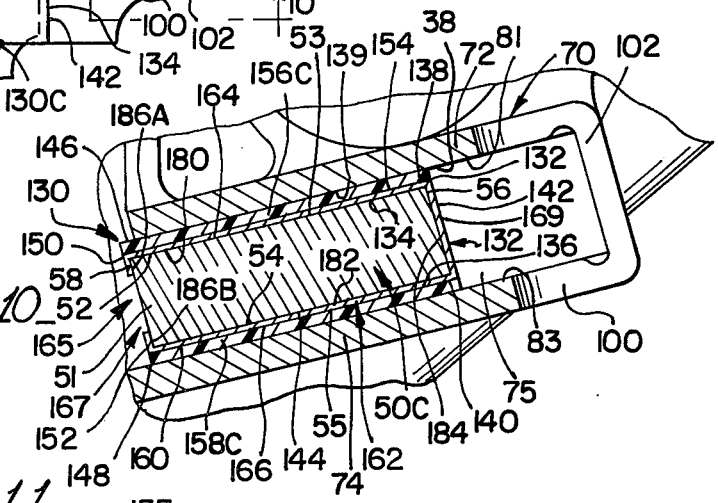

The slide bearing 130C (see FIGS. 9 and 10) is similar to slide bearing 130, but has its clip member 132C received on guide lug 44B that is of the solid construction type (as indicated in FIG. 10 for body 50C), that illustrated being intended to represent the guide lugs employed on Davis one piece head unit brake beams offered by Davis Brake Beam Company of Johnstown, Pa. (see page 613 of the 1980 edition of the Car and Locomotive Cyclopedia). In this embodiment, clip member 132C is the same as clip member 132, but is proportioned for fitting on the guide lug 44B and the similarly contoured guide lug at the other end of the brake beam in a manner similar to the fit of clip member 132 on lugs 44 and 46, with the strippings 156C and 158C being proportioned lengthwise and thickness wise in the same manner as the corresponding parts of bearing 130.

Figure 11:
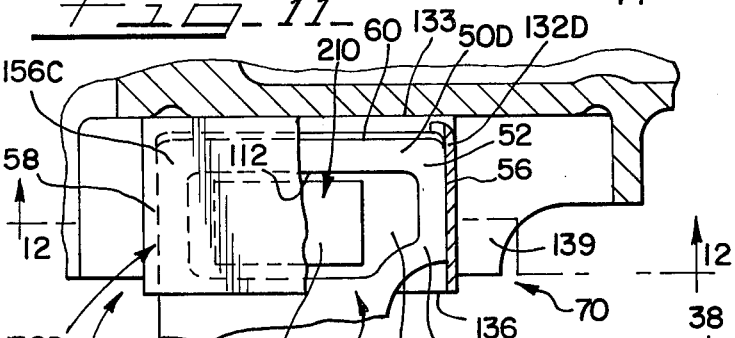
Figure 12:
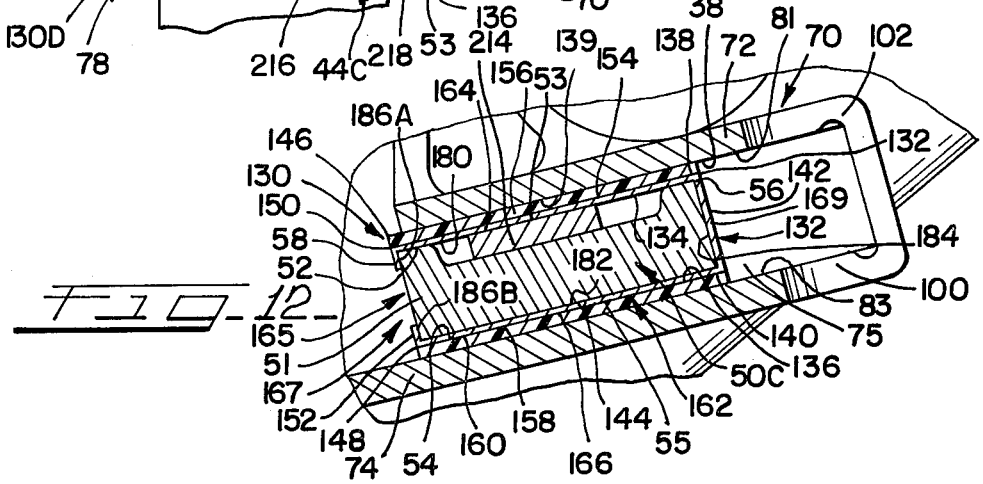

The slide bearing 130D (see FIGS. 11 and 12) is also similar to slide bearing 130, but has its clip member 132D received over guide lug 44C that is also of the solid construction type, but is formed in its upper surface 53 to define centrally located recess 210 (as indicated in FIG. 14 for body 50D), that illustrated being intended to represent the guide lugs employed on Creco hangerless brake beam offered Creco Division of Evans Products Company (see pages 620 and 621 of the said 1980 edition of the Car and Locomotive Cyclopedia). In this embodiment, the clip member 132D is the same as clip member 132, but is proportioned for fitting on the guide lug 44C (and the similarly contoured guide lug at the other end of the brake beam) in a manner similar to the fit of clip member 132 on lugs 44 and 46, with the strippings 156D and 158D being proportioned lengthwise and thickness wise in the same manner as the corresponding parts of bearing 130. In this embodiment metallic bracing 214 or its equivalent is preferably employed between the spacer clip member arm 134 and lug body 50D within recess 210 Spacer 214 may be in the form of suitable slug 216 of quadrilateral (as shown in FIG. 11) or other suitable configuration, proportioned to fill the space between the lug recess floor 218 and clip member arm 134, but otherwise may be loosely received in recess 210.

The slide bearings 130C and 130D provide the same action and advantages as described for bearing 130.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a railroad car truck including spaced side frames riding on a pair of first and second wheeled truck axles, a bolster intermediate said axles and resiliently supported at either end of same from the respective side frames by a spring group interposed between the spring seats of the respective bolster ends and the side frames supporting same, first and second unit brake beams disposed one on either side of the bolster, with the first brake beam having brake heads adjacent each end of same each equipped with a brake shoe for braking application to the wheels of the first truck axle, and with the second brake beam having brake heads adjacent each end of same each equipped with a brake shoe for braking application to the wheels of the second truck axle, said brake beams each having guide lugs at their respective ends, with the side frames on their in board sides defining for the first brake beam a first pair of opposed guide brackets each defining a guide slot lying on a radius of the first truck axle in which said first brake beam guide lugs are respectively mounted for movement along said first truck axle radius in a plane that includes said first brake beam guide slots, and with the side frames on the in board sides defining for the second brake beam a pair of opposed guide brackets each defining a guide slot lying on a radius of the second truck axle in which said second brake beam guide lugs are respectively mounted for movement along said second truck axle in a plane that includes said second brake beam guide slots, said guide lugs each being of U-shaped section defining a web portion that faces the respective side frames and upper and lower side flanges projecting from said web portion for connection to the brake beam main beam, and power means for moving the respective brake beams along the respective slots to seat the respective brake shoes against the respective truck wheels to apply the truck brakes, the improvement wherein:

a bearing structure is mounted on each of said brake beam guide lugs for slidably mounting same in the respective side frame guide brackets, said bearing structures each comprising:

a resiliently flexible clip member comprising a pair of spaced apart arms joined together in one piece U-shaped construction relation by a web at like ends of same, said arms being of film thickness dimensions, said arms at their other ends being angled toward each other to define for each said arm a locating stop spaced from said web approximately the length of said lugs, said arms each having affixed to the outer surfacing of same a strip of a polymer material of dry self lubricating characteristics, said strips being planar and rectilinear in outline and extending the major portion of the length of the respective arms, said arms being spaced apart to receive the guide lug mounted therein in snap fit relation thereto lengthwise thereof with one of said arms disposed on the upper side of the guide lug and the other arm disposed under the lower side of the guide lug, and with said stops engaging a side edging of the guide lug, said bearing structures being respectively slidably received within the respective side frame guide slots to mount said brake beams, respectively, for said movement of same along the respective guide slots under the action of said power means, said strips being proportioned for substantially complemental fit of the respective bearing structures within the respective guide slots for maintaining said brake beams, respectively, in substantial coplanar relation with the axle radius of the guide bracket guide slots in which the respective brake beams are mounted, whereby on actuation of said power means the brake beam shoes are presented in flush relation with the respective truck wheels.

2. The improvement set forth in claim 1 wherein:

said outer surfacings of said strips of said bearing structures have a coefficient of friction of about 0.15 with respect to steel, and said outer surfacings of said strips ride directly on said guide brackets, respectively, of the respective guide brackets.

3. The improvement set forth in claim 1 wherein:

said outer surfacings of said strips of said bearing structures have a coefficient of friction of about 0.15 with respect to steel, said guide brackets of each pair of guide brackets each bearing a spring steel U-shaped wear plate, with said strip surfacings of the respective bearing structures riding within the respective wear plates.

4. The improvement set forth in claim 1 wherein:

said clip member is formed from spring steel.

5. The improvement set forth in claim 4 wherein:

said strips are formed from an ultra high molecular weight polyethylene and are of one piece construction.

6. The improvement set forth in claim 5 wherein:

said strips are proportioned to engage the guide bracket floor and space said clip member therefrom.

7. A bearing structure for application to railroad car truck side frame unit brake beam guide lugs for mounting the unit brake beam in the truck side frame guide lug guide brackets for movement toward and away from the truck axle with flush engagement of the brake beam shoes with the axle which when braking is effected, wherein the brake beam guide lugs each comprise a sheet metal member of U configuration defining a web portion and upper and lower side flanges integral with said web portion and defining straps that are apertured for connection to the brake beam main beam, with the lug web portion and side flanges defining the lug forward and rearward edgings, and the lug projecting end edging that faces oppositely of said straps, said bearing structure comprising:

a resiliently flexible clip member comprising a pair of spaced apart arms of generally rectilinear configuration lengthwise thereof joined together in one piece U-shaped construction relation by a web bridging like ends of same, said arms being of film thickness dimensions, said arms at their other ends being angled toward each other to define for each said arm a locating stop spaced from said web approximately the length of said lug between said edgings thereof, said arms each having affixed to the outer surfacing of same a strip of an ultra high molecular weight resiliently flexible polymer material of dry self lubricating characteristics, said clip member arms and web forming a mounting pocket for receiving the brake beam guide lug to be applied in same, said strips being shaped and proportioned such that when the guide lug is received in said clip member mounting pocket and said bearing structure is in the truck side frame guide bracket, said strips are in complemental fit reciprocatory seating relation in the guide brackets so as to dispose said strips in substantial parallelism with the respective guide brackets.

8. The bearing structure set forth in claim 7 wherein:

the outer surfacings of said strips have a coefficient of friction of about 0.15 with respect to steel and are shaped to ride directly in the truck side frame guide bracket in place of the conventional spring steel liner.

9. The bearing structure set forth in claim 7 wherein:

the outer surfacings of said body side walls have a coefficient of friction of about 0.15 with respect to steel and are shaped to ride within a conventional spring steel liner mounted in the truck side frame guide bracket.

10. The bearing structure set forth in claim 7 wherein:

said strips are formed from ultra high molecular weight polyethylene and are each of one piece construction.

11. In a railroad car truck including spaced side frames riding on a pair of first and second wheeled truck axles, a bolster intermediate said axles and resiliently supported at either end of same from the respective side frames by a spring group interposed between the spring seats of the respective bolster ends and the side frames supporting same, first and second unit brake beams disposed one on either side of the bolster, with the first brake beam having brake heads adjacent each end of same each equipped with a brake shoe for braking application to the wheels of the first truck axle, and with the second brake beam having brake heads adjacent each end of same each equipped with a brake shoe for braking application to the wheels of the second truck axle, said brake beams each having guide lugs at their respective ends, with the side frames on their in board sides defining for the first brake beam a first pair of opposed guide brackets each defining a guide slot lying on a radius of the first truck axle in which said first brake beam guide lugs are respectively mounted for movement along said first truck axle radius in a plane that includes said first brake beam guide slots, and with the side frames on the in board sides defining for the second brake beam a pair of opposed guide brackets each defining a guide slot lying on a radius of the second truck axle in which said second brake beam guide lugs are respectively mounted for movement along said second truck axle in a plane that includes said second brake beam guide slots, said guide lugs each defining an edge portion that faces the respective side frames and forward and rearward side edges, and power means for moving the respective brake beams along the respective slots to seat the respective brake shoes against the respective truck wheels to apply the truck brakes, the improvement wherein:

a bearing structure is mounted on each of said brake beam guide lugs for slidably mounting same in the respective side frame guide brackets, said bearing structures each comprising:

a resiliently flexible clip member comprising a pair of spaced apart arms joined together in one piece U-shaped construction relation by a web at like ends of same, said arms being of sheet metal thickness dimensions, said arms at their other ends being angled toward each other to define for each said arm a locating stop spaced from said web approximately the length of said lugs, said arms each having affixed to the outer surfacing of same a strip of a polymer material of dry self lubricating characteristics, said strips being planar and rectilinear in outline and extending approximately the length of the respective arms, said arms being spaced apart to receive the guide lug mounted therein in snap fit relation thereto lengthwise thereof with one of said arms disposed on the upper side of the guide lug and the other arm disposed under the lower side of the guide lug, and with said stops engaging a side edging of the guide lug, said bearing structures being respectively slidably received within the respective side frame guide slots to mount said brake beams, respectively, for said movement of same along the respective guide slots under the action of said power means, said strips being proportioned for substantially complemental fit of the respective bearing structures within the respective guide slots along the lengths of said strips for maintaining said brake beams, respectively, in substantial coplanar relation with the axle radius of the guide bracket guide slots in which the respective brake beams are mounted, whereby on actuation of said power means the brake beam shoes are presented in flush relation with the respective truck wheels.

12. The improvement set forth in claim 11 wherein:

said outer surfacings of said strips of said bearing structures have a coefficient of friction of about 0.15 with respect to steel, and said outer surfacings of said strips ride directly on said guide brackets, respectively, of the respective guide brackets.

13. The improvement set forth in claim 11 wherein:

said outer surfacings of said strips of said bearing structures have a coefficient of friction of about 0.15 with respect to steel, said guide brackets of each pair of guide brackets each bearing a spring steel U-shaped wear plate, with said strip surfacings of the respective bearing structures riding within the respective wear plates.

14. The improvement set forth in claim 11 wherein:

said clip member is formed from spring steel.

15. The improvement set forth in claim 14 wherein:

said strips are formed from an ultra high molecular weight polyethylene and are of one piece construction.

16. The improvement set forth in claim 15 wherein:

said strips are proportioned to engage the guide bracket floor and space said clip member therefrom.

17. A bearing structure for application to railroad car truck side frame unit brake beam guide lugs for mounting the unit brake beam in the truck side frame guide lug guide brackets for movement toward and away from the truck axle with flush engagement of the brake beam shoes with the axle which when braking is effected, wherein the brake beam guide lugs each define the lug forward and rearward edgings, and the lug projecting end edging said bearing structure comprising:

a resiliently flexible clip member comprising a pair of spaced apart arms of generally rectilinear configuration lengthwise thereof joined together in one piece U-shaped construction relation by a web bridging like ends of same, said arms being of film thickness dimensions, said arms at their other ends being angled toward each other to define for each said arm a locating stop spaced from said web approximately the length of said lug between said edgings thereof, said arms each having affixed to the outer surfacing of same s strip of an ultra high molecular weight resiliently flexible polymer material of dry self lubricating characteristics, said clip member arms and web forming a mounting pocket for receiving the brake beam guide lug to be applied to same, said strips being shaped and proportioned such that when the guide lug is received in said clip member mounting pocket and said bearing structure is in the truck side frame guide bracket, said strips are in complemental fit reciprocatory seating relation in the guide brackets so as to dispose said strips in substantial parallelism with the respective guide brackets.

18. The bearing structure set forth in claim 17 wherein:

the outer surfacings of said strips have a coefficient of friction of about 0.15 with respect to steel and are shaped to ride directly in the truck side frame guide bracket in place of the conventional spring steel liner.

19. The bearing structure set forth in claim 17 wherein:

the outer surfacings of said body side walls have a coefficient of friction of about 0.15 with respect to steel and are shaped to ride within a conventional spring steel liner mounted in the truck side frame guide bracket.

20. The bearing structure set forth in claim 17 wherein:

said strips are formed from ultra high molecular weight polyethylene and are each of one piece construction.

* * * * *